United States Patent [19]

Gardiner

[11] Patent Number: 4,587,683

[45] Date of Patent: May 13, 1986

[54] ZIP-ON ZIP-OFF DUST RUFFLE

[76] Inventor: Reginald Gardiner, 57 Long Dr., Hempstead, N.Y. 11550

[21] Appl. No.: 717,596

[22] Filed: Mar. 29, 1985

Related U.S. Application Data

[63] Continuation of Ser. No. 570,588, Jan. 13, 1984, abandoned.

[51] Int. Cl.[4] ..... A47G 9/04

[52] U.S. Cl. ..... 5/493; 5/497

[58] Field of Search ..... 5/493, 497, 482, 496, 5/495, 484, 498, 499

[56] References Cited

U.S. PATENT DOCUMENTS

| | | | |
|---|---|---|---|
| D. 160,856 | 4/1950 | Goodstein | 5/493 |
| 2,139,980 | 12/1938 | Simon | 5/493 |
| 2,319,150 | 5/1943 | Mink | 5/499 |
| 2,763,875 | 9/1956 | Piontkowski | 5/493 |
| 2,857,643 | 10/1958 | Tomsic | 5/496 |
| 3,113,326 | 12/1963 | Hyde et al. | 5/484 |
| 3,144,666 | 8/1964 | Mazera et al. | 5/493 |
| 4,461,049 | 7/1984 | Hammond | 5/496 |

OTHER PUBLICATIONS

"Pacific Bedding", Sheet Instructions Available from Pacific Bedding, 8-B Wrigley Ave., Irvine, Calif. 92714, 3/1983 (or earlier).

*Primary Examiner*—Alexander Grosz

*Attorney, Agent, or Firm*—Leonard Belkin

[57] ABSTRACT

This invention is a dust ruffle, including a dust ruffle member attachable by a slide fastener to a cover member fitted around opposite ends of a bed box spring.

2 Claims, 4 Drawing Figures

FIG. 1
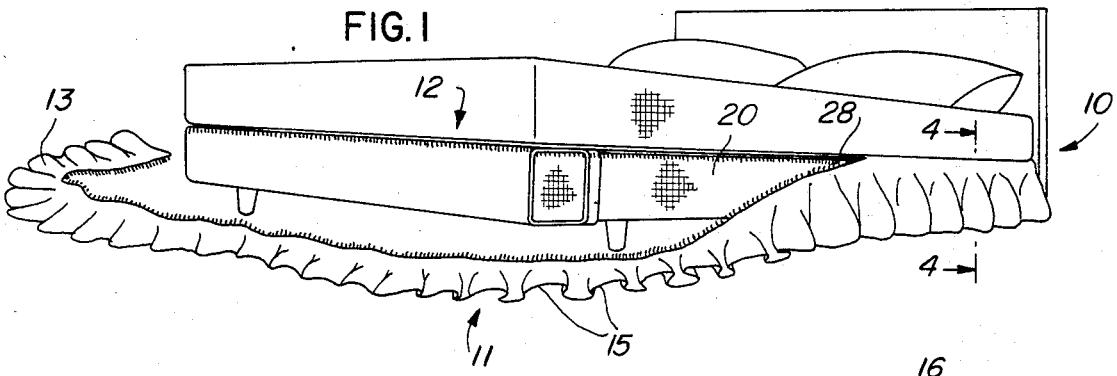
FIG. 2
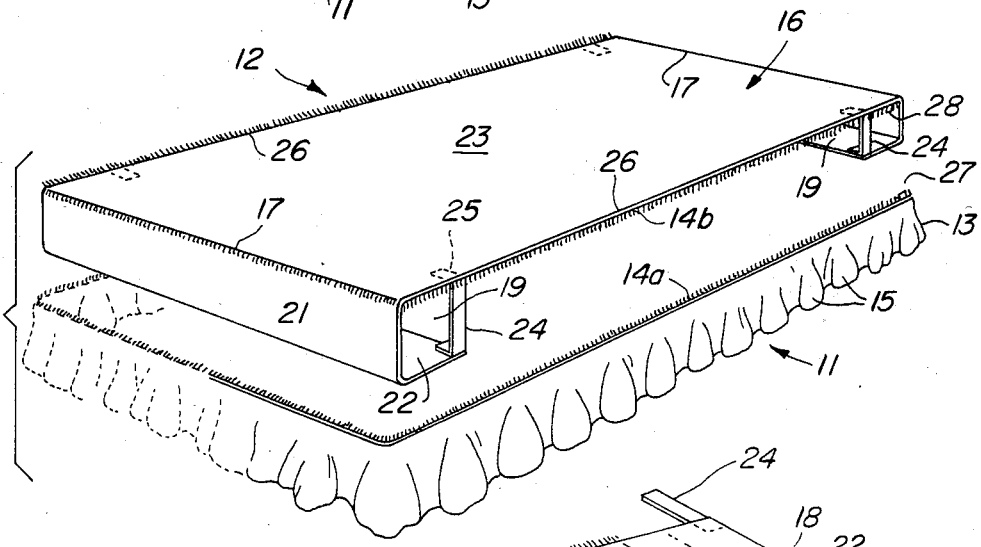
FIG. 3
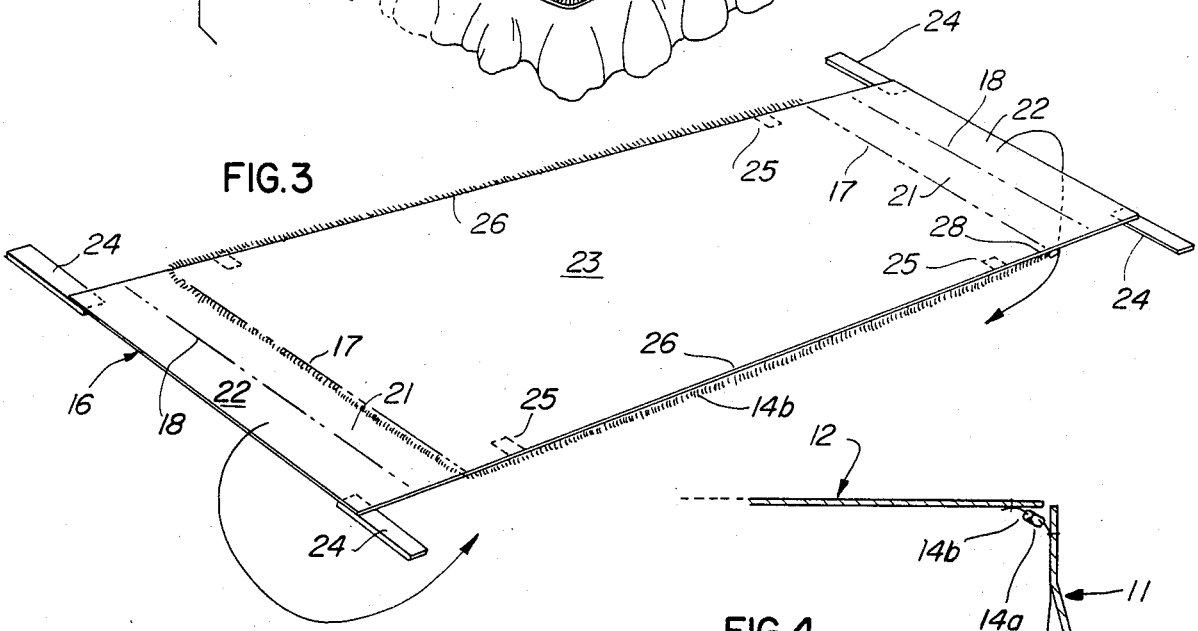
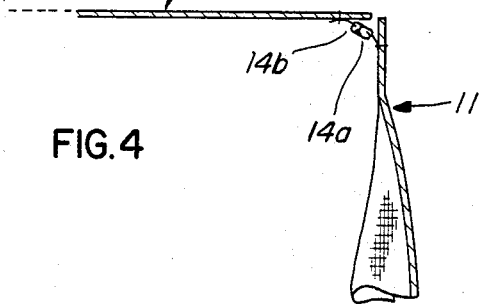
FIG. 4

ZIP-ON ZIP-OFF DUST RUFFLE

This application is a continuation of my application Ser. No. 570,588 filed on Jan. 13, 1984, now abandoned.

This invention relates generally to dust ruffles, such as for a depending apron from an article of furniture, or the like.

It is well known that many furniture items, such as sofas, chairs and furniture covers, are made with dust ruffles for the purpose of an attractive appearance, and prevention of dust collection therebeneath. In some situations, such as on upholstered furniture, they are permanently attached, while in other situations, such as around bed box springs or the like, they may be detachably attached thereto, by means of pins, in order to be removable for purposes of laundering. Such pinning takes effort and time to accomplish.

Accordingly, it is a principal object of the present invention to provide a dust ruffle for a box spring or the like, and which has the advantage of being quickly and easily installed or removed by means of a slide fastener, so that it may be more conveniently zipped on or off, instead of pinning.

Another object is to provide a zip-on, zip-off dust ruffle, which is readily interchangeable with other dust ruffles of different style, color or pattern, in order to suit any changing color scheme or decor of a room.

Other objects are to provide a zip-on, zip-off dust ruffle, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of a dust ruffle, shown in the process of being zipped during installation around a bed box spring;

FIG. 2 is a perspective view of the dust ruffle components, shown per se, and in separated position;

FIG. 3 is a perspective view of one of the components, shown prior to a final folding and stitching operation during its manufacture, and FIG. 4 is an enlarged cross-sectional view, taken on line 4—4 of FIG. 1.

Referring now to the drawing in greater detail, the reference numeral 10 represents a zip-on zip-off dust ruffle, according to the present invention, wherein there is a depending valance or dust ruffle member 11, and a box spring cover member 12, to which the dust ruffle member 11 is selectively attachable.

The dust ruffle member 11 comprises a length of decorative fabric material 13, having a slide fastener component **14*a* stitched along one entire longitudinal edge thereof. As shown in the drawing, the material may be gathered, if preferred, so as to form ornamental pleats 15**.

The cover member 12 comprises a rectangular panel of fabric 16, which, at each opposite end, is folded over about two parallel fold lines 17 and 18, in order to form a pocket 19, into which one end of a box spring 20 is receivable. Each pocket, accordingly, is formed having one end wall 21, a bottom wall 22 and one end portion of a top wall 23, that covers the top of the box spring. The pocket is made permanent by means of an elastic tape 24, stitched to each opposite corner of the fabric panel 15, and also stitched to a location 25 along each opposite longitudinal edge of the fabric panel. The tape length is preferably such so that it must be stretched in order to make the pocket snug for the box spring end. A slide fastener component **14*b*, for mating with the slide fastener component 14*a*, is stitched extending around three side edges of top wall 23, including both longitudinal edges 26 of the top wall, and one of the fold lines 17, so that the hung dust ruffle member covers three sides of the box spring. Both side fasteners are the same length; the slide fastener component 14*a* having the male end fitting 27, which is slidably receivable in a female latching fitting 28, slidable along the slide fastener component 14*b***.

It is now evident that a dust ruffle member 11 can be quickly and easily installed in place, or removed for laundering or interchange.

While various changes may be made in the detail construction, it is understood that such changes will be within the spirit and scope of the present invention, as is defined by the appended claims.

What I now claim is:

1. In combination with a rectangular box spring having a length and a width, cover means extending along the length of and on the top surface of said box spring and folded under the ends only of said box spring forming fold lines at the ends of said box spring extending the width thereof and leaving the sides of said box spring fully uncovered, said cover means covering completely the top surface of said box spring and having exposed side edges along the length of said box spring, means for retaining said cover means in place comprising elastic means engaged with said cover means along the sides of said box spring at each of the extremities of said cover member connected between the fold of said cover means under said box spring and the portion of said cover means located on the top surface of said box spring, said elastic means attached at both ends to said cover means on the side of the latter facing said box spring so that there is no exposed elastic means on either the top surface of said box spring or under said box spring and cover means, and dust ruffle means for protecting three sides of said box spring from the collection of dust including slide fastener means for attaching said dust ruffle means to said cover means along both exposed edges of said cover means along the lengths of said box spring and a fold line on said cover means along a width of said box spring, said dust ruffle consisting of a single continuous member extending along the aforesaid three sides of said box spring.

2. The combination as set forth in claim 1 in which said slide fastener means is a zipper in which said dust ruffle means is engaged and disengaged in sequence along one length, one width, and a second length of said box spring.

* * * * *